US007357541B2

(12) United States Patent
Gamache et al.

(10) Patent No.: US 7,357,541 B2
(45) Date of Patent: Apr. 15, 2008

(54) ENCLOSURE FOR SOCKET CUP FOR SNAP-IN ELECTRICAL QUICK CONNECTORS

(75) Inventors: Thomas J. Gamache, Fall River, MA (US); James N. Neeld, Tiverton, RI (US); Graham M. Ripple, South Easton, MA (US)

(73) Assignee: Genlyte Thomas Group, LLC, Louisville, KY (US)

( * ) Notice: Subject to any disclaimer, the term of this patent is extended or adjusted under 35 U.S.C. 154(b) by 113 days.

(21) Appl. No.: 10/818,558

(22) Filed: Apr. 5, 2004

(65) Prior Publication Data

US 2005/0227536 A1 Oct. 13, 2005

(51) Int. Cl.
*F21V 17/00* (2006.01)

(52) U.S. Cl. ..... 362/448; 362/147; 362/148; 362/364; 362/382; 362/449; 248/343; 248/314; 174/58; 174/60; 174/63; 174/64

(58) Field of Classification Search ..... 362/147, 362/148, 364, 375, 453, 432, 437, 448, 449, 362/382; 174/58, 60, 63, 64; 439/226, 518; 248/343, 314

See application file for complete search history.

(56) References Cited

U.S. PATENT DOCUMENTS

| | | | |
|---|---|---|---|
| 1,264,015 | A | 4/1918 | Cochrane |
| 2,319,621 | A | 5/1943 | Laughlin |
| 2,335,218 | A | 11/1943 | Vacha |
| 2,489,245 | A | 11/1949 | Sola |
| 2,639,368 | A | 5/1953 | Pryne |
| 2,702,378 | A | 2/1955 | Talty |
| 2,757,818 | A | 8/1956 | Chamberlain |
| 2,842,281 | A | 7/1958 | Chisholm |
| 3,057,993 | A | 10/1962 | Gellert |
| 3,082,023 | A | 3/1963 | Rudolph et al. |
| 3,144,502 | A | 8/1964 | Weiss |
| 3,168,613 | A | 2/1965 | Palmer |
| 3,247,368 | A | 4/1966 | McHugh |
| 3,281,522 | A | 10/1966 | Anisfield |
| 3,360,152 | A | 12/1967 | Leers |
| 3,420,995 | A | 1/1969 | Dunckel |
| 3,428,737 | A | 2/1969 | Pou |
| 3,495,024 | A | 2/1970 | Bowman |
| 3,590,241 | A | 6/1971 | Docimo et al. |
| 3,597,889 | A | 8/1971 | Nigro |
| 3,630,406 | A | 12/1971 | Hammes |
| 3,647,934 | A | 3/1972 | Hurtt |
| 3,648,878 | A | 3/1972 | Mackay et al. |
| 3,715,627 | A | 2/1973 | D'Ausillo |
| 3,749,873 | A | 7/1973 | Harper et al. |
| 3,751,574 | A | 8/1973 | Fisher |
| 4,001,571 | A | 1/1977 | Martin |
| 4,039,822 | A | 8/1977 | Chan et al. |

(Continued)

*Primary Examiner*—Jacob Y. Choi
(74) *Attorney, Agent, or Firm*—James E. Cole; Middleton Reutlinger

(57) ABSTRACT

An enclosure with socket cup for use with a line voltage recessed lighting kit, having an enclosure for a splice connection between a lamp holder and a junction box, the enclosure having an open portion. The invention further comprises a socket cup having at least one socket cup sidewall engaging the open portion of the enclosure. The socket cup provides a pathway for wiring from within the socket cup to an interior of the enclosure. The enclosure with socket cup may be utilized with reflector trims of differing heights.

25 Claims, 7 Drawing Sheets

U.S. PATENT DOCUMENTS 4,041,657 A 8/1977 Schuplin
4,043,629 A 8/1977 Brannen
4,086,480 A 4/1978 Lahm
4,104,713 A 8/1978 Chan et al.
4,114,327 A 9/1978 Williams
4,146,287 A 3/1979 Jonsson
4,173,286 A 11/1979 Stanko
4,230,900 A 10/1980 Speet
4,230,916 A 10/1980 Mochizuki
4,232,361 A 11/1980 Kelsall
4,247,738 A 1/1981 Bonato
4,272,689 A 6/1981 Crosby et al.
D260,090 S 8/1981 Hughes et al.
4,318,161 A 3/1982 Shanks
4,318,162 A 3/1982 Sip
4,367,417 A 1/1983 Casasanta
4,382,274 A 5/1983 De Backer et al.
4,393,435 A 7/1983 Petrina
4,399,371 A 8/1983 Ziff et al.
4,408,262 A 10/1983 Kusmer
4,428,492 A 1/1984 Jorgensen
4,437,142 A 3/1984 Donato et al.
4,449,168 A 5/1984 Ewing
4,500,796 A 2/1985 Quin
4,507,719 A 3/1985 Quiogue
4,591,658 A 5/1986 Bauer et al.
4,605,816 A 8/1986 Jorgensen et al.
4,623,956 A 11/1986 Conti
4,646,212 A 2/1987 Florence
4,661,885 A 4/1987 Brenner et al.
4,674,015 A 6/1987 Smith
4,686,381 A 8/1987 Boteler et al.
4,704,664 A 11/1987 McNair
4,729,740 A 3/1988 Crowe et al.
4,741,434 A 5/1988 Liebman
4,751,624 A 6/1988 Russo et al.
4,754,377 A 6/1988 Wenman
4,842,551 A 6/1989 Heimann
4,875,871 A 10/1989 Booty, Sr. et al.
4,897,627 A 1/1990 Van Wagener et al.
4,918,258 A 4/1990 Ayer
4,924,032 A 5/1990 Akins
4,958,048 A 9/1990 Bell
4,969,070 A 11/1990 Costa
4,979,616 A 12/1990 Clanton
5,006,764 A 4/1991 Swanson et al.
5,057,647 A 10/1991 Bogden et al.
5,064,385 A 11/1991 Harlow, Jr.
5,096,433 A 3/1992 Boundy
5,124,901 A 6/1992 Sojka et al.
5,138,528 A 8/1992 Altman et al.
5,222,800 A * 6/1993 Chan et al. ..... 362/147
5,253,152 A 10/1993 Yang et al.
5,260,678 A 11/1993 Van Wagener et al.
5,272,279 A 12/1993 Filshie
5,347,088 A 9/1994 Marsh et al.
5,373,431 A 12/1994 Hayman et al.
5,374,812 A 12/1994 Chan et al.
5,377,075 A 12/1994 Schmid et al.
5,398,179 A 3/1995 Pacheco
5,410,462 A 4/1995 Wolfe
5,452,816 A 9/1995 Chan et al.
5,457,617 A 10/1995 Chan et al.
5,550,723 A * 8/1996 Ullman ..... 362/260
5,562,343 A 10/1996 Chan et al.
5,588,737 A 12/1996 Kusmer
5,609,413 A 3/1997 Lecluze
5,664,869 A 9/1997 Bitton
5,707,143 A 1/1998 Hentz
5,715,808 A 2/1998 Wilhoite
5,720,540 A 2/1998 Crown et al.
5,741,064 A 4/1998 Chin et al.
5,758,959 A 6/1998 Sieczkowski
5,800,050 A 9/1998 Leadford
5,836,678 A 11/1998 Wright et al.
5,845,988 A 12/1998 Mandall
5,857,766 A * 1/1999 Sieczkowski ..... 362/365
5,908,235 A 6/1999 Petrozello et al.
5,957,573 A 9/1999 Wedekind et al.
5,957,574 A 9/1999 Hentz et al.
6,062,704 A 5/2000 Holder
6,098,825 A 8/2000 Kohnen
6,102,550 A 8/2000 Edwards, Jr.
6,102,733 A 8/2000 Anderson, Jr. et al.
6,133,529 A 10/2000 Gretz
6,166,329 A 12/2000 Oliver et al.
6,272,794 B1 8/2001 Rippel et al.
6,283,430 B1 * 9/2001 Schubert et al. ..... 248/343
6,290,375 B1 9/2001 Le Vasseur
6,293,510 B1 9/2001 Bradford et al.
6,343,873 B1 2/2002 Eberhard et al.
6,364,510 B1 4/2002 Bernhart et al.
6,369,326 B1 4/2002 Rippel et al.
6,383,032 B1 5/2002 Gergerding
6,431,723 B1 8/2002 Schubert et al.
6,461,016 B1 * 10/2002 Jamison et al. ..... 362/147
6,582,106 B2 6/2003 Jamison
6,632,006 B1 10/2003 Rippel et al.
6,655,813 B1 * 12/2003 Ng ..... 362/148
6,659,627 B2 12/2003 Caluori
6,747,206 B1 6/2004 Law
6,777,611 B2 8/2004 Ewald et al.
6,979,097 B2 * 12/2005 Elam et al. ..... 362/148
2002/0172047 A1 11/2002 Ashley
2003/0095413 A1 5/2003 Jamison
2005/0227536 A1 10/2005 Gamache et al.

* cited by examiner

ENCLOSURE FOR SOCKET CUP FOR SNAP-IN ELECTRICAL QUICK CONNECTORS

CROSS REFERENCES TO RELATED APPLICATIONS

None.

STATEMENT REGARDING FEDERALLY SPONSORED RESEARCH OR DEVELOPLMENT

None.

REFERENCE TO SEQUENTIAL LISTINGS, ETC.

None.

BACKGROUND

1. Field of the Invention

The present invention comprises a remodeler frame-in kit for recessed lighting. More specifically, the present invention provides an enclosure with a socket cup for use with a remodeler frame-in recessed lighting kit utilized at line voltage which accepts a plurality of reflector trims of varying height and electrically connects the lighting kit by wiring harness connector.

2. Description of the Related Art

Remodeling of commercial and residential space is increasing as the cost of new construction increases and attractive building locations for new constructions diminish. One area of remodeling which incurred significant growth is in the lighting industry. Recessed lighting is very popular among those undertaking remodeling plans because of the lighting characteristics provided by the fixture and because of the non-intrusive nature of the fixture into the room.

Recessed lighting remodeler kits are generally sold in at least two configurations: low voltage and line voltage. One characteristic associated with line voltage recessed lighting kits as opposed to low voltage kits is that the line voltage lamps are larger and therefore the housings are longer in a vertical dimension. Further, the reflector trims must be larger to accept lamps of a longer length.

In order to accommodate the larger lamps and reflector trims associated with the line voltage recessed lighting kits, an open construction housing was developed wherein the upper portion of the can or housing is removed. One advantage of the open construction housing is that the design provides for improved thermodynamic transfer to a plenum above a ceiling wherein the recessed light is positioned. Thus thermal overloading is inhibited. Another advantage of the open housing construction design is that reflectors having varying height dimensions may be utilized whereas closed construction cans restrict the height of the reflectors capable of being used therewith.

The development of the open construction housing has led to an additional problem. Removal of the upper portion of the housing or can reveals a splice connection between the electrical wiring extending from the lamp holder and the wiring extending from the junction box. However, electrical code requires all splice connections to be enclosed in order to inhibit contact with flammable or combustible materials such as floor joists disposed above a lower ceiling.

Heretofore none of the known recessed lighting kits have included an upper enclosure portion adapted to receive a plurality of reflector trim sizes and contain a splice in combination with an open construction housing.

SUMMARY OF THE INVENTION

With regard to the foregoing, the present invention eliminates the oversights, difficulties, and disadvantages of the prior art by providing an enclosure with socket cup.

It is an object of the present invention to provide an enclosure with socket cup for a recessed lighting kit.

It is a further object of the present invention to provide an enclosure with socket cup for use with an open construction housing with a recessed lighting kit.

It is still a further object of the present invention to provide an enclosure that may be utilized with a plurality of reflector trims of varying height.

It is still an even further object of the present invention to provide an enclosure with socket cup for housing snap-in electrical quick connections.

More specifically, the present invention is for an enclosure with socket cup, comprising an enclosure having a top wall, at least one enclosure sidewall extending between the top wall and a releasably attached plate providing access to an interior of the enclosure. The enclosure further comprising an open portion. A socket cup comprises a socket cup top wall and at least one sidewall depending from the top wall and disposed against the open portion of the enclosure. The at least one socket cup sidewall includes a pathway between the socket cup and the enclosure. The enclosure with socket cup of the present invention may be used with an open construction housing in order to receive reflector trims of various height as well as providing a location for quick connectors.

DETAILED DESCRIPTION

Given the foregoing deficiencies, it will be appreciated that an enclosure is needed for use with an open construction recessed lighting housing which allows for connection with a plurality of reflector trims of different height.

Referring now in detail to the drawings, wherein like numerals indicate like elements through out the several views, there is shown in FIGS. 1-7 various aspects of an enclosure with socket cup for snap-in electrical quick connectors. The enclosure with socket cup 10 may be utilized with a plurality of reflector trims of different height and provides an enclosure wherein a splice connection, for instance formed by quick connectors, may be housed between a lamp holder and a junction box in order to provide power to a lamp at line voltage.

Figure 1:
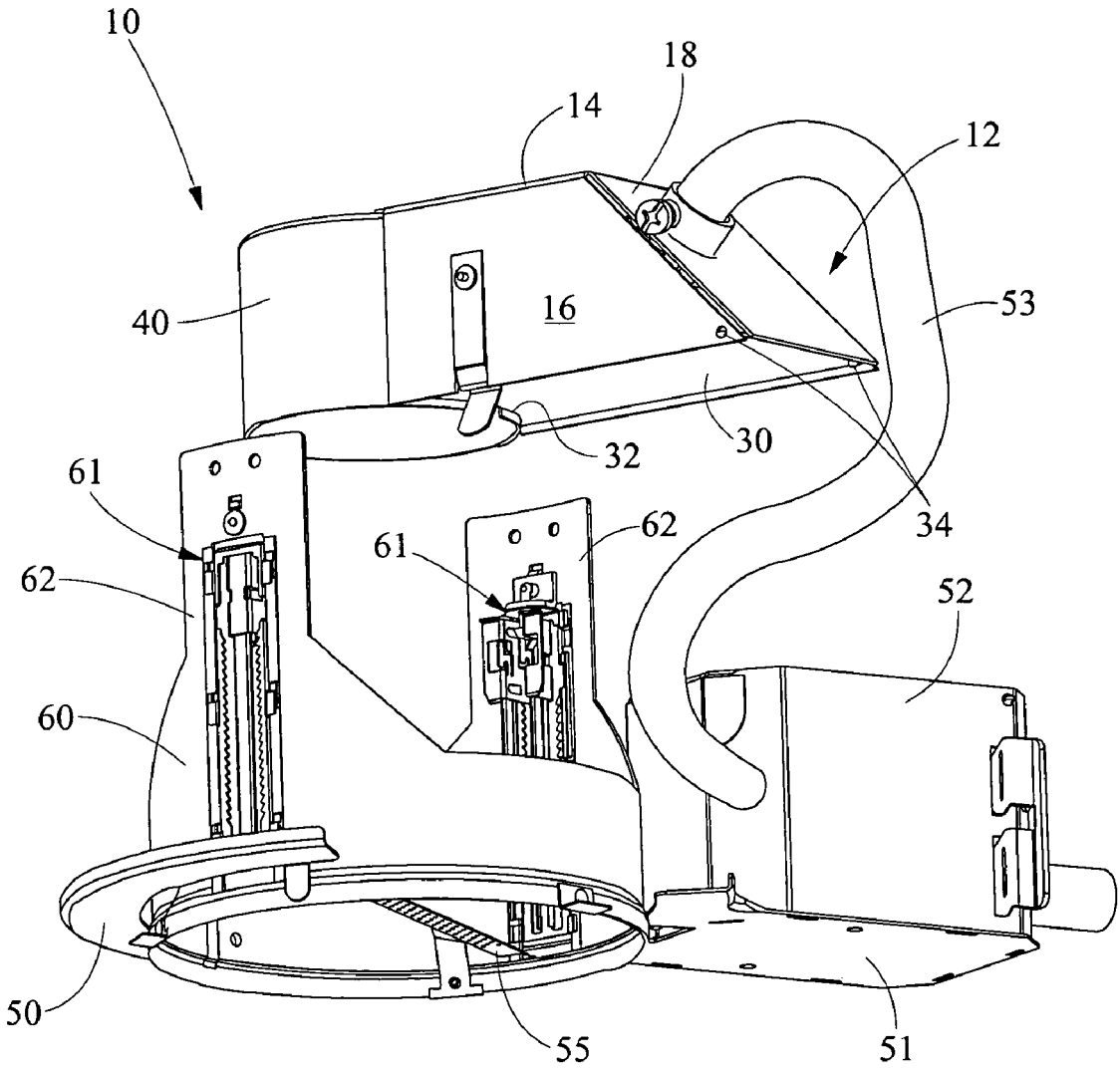
FIG. 1 is a perspective view of a remodeler recessed lighting kit including an enclosure with socket cup of the present invention.

Referring initially to FIG. 1, a remodeler recessed lighting kit is generally shown in a perspective view comprising the enclosure with socket cup 10 positioned above a housing 60, without a reflector for clarity, which is positioned within a C-shaped frame 50 having a platform 51 providing for positioning of a junction box 52 in a spaced relation from the housing 60. FIGS. 1-4 generally depict the environment in which the enclosure with socket cup 10 is disposed for use with a remodeler recessed lighting kit. Generally, the frame 50 is C-shaped to allow positioning of the frame through a pre-existing aperture in a ceiling. More specifically, the frame has an inner diameter larger than a ceiling aperture and therefore is C-shaped to place the frame 50 through and above the ceiling aperture. Extending from the C-shaped frame 50 is a platform for positioning of junction box 52 thereon. The platform 51 is designed to position the junction box 52 in a spaced relationship from the heat emitted from the lamp (not shown) and reflector 70, seen in FIG. 4. Upon installation, the platform 51 and junction box 52 are also positioned above a ceiling aperture within a plenum area defined between a ceiling and a substrate or other structure above the ceiling. Thus, once installed, the C-shaped frame 50, platform 51 and junction box 52 are not seen by someone standing beneath the recessed lighting kit.

Figure 4:
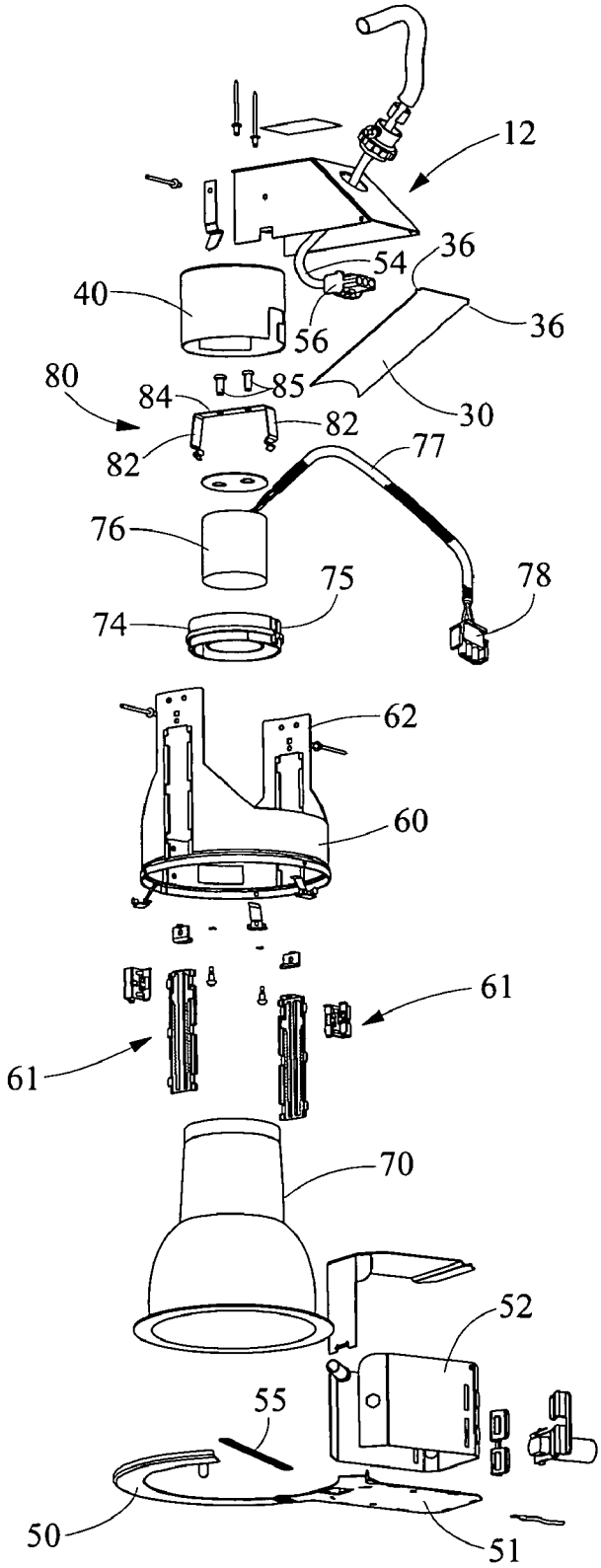
FIG. 4 is an exploded perspective view of the remodeler recessed lighting kit of FIG. 1 including the enclosure with socket cup.

Within the C-shaped frame 50 is a housing 60 wherein a reflector trim 70, shown in FIG. 4, may be positioned. The housing 60 has an open construction meaning the upper portion of the housing is removed. Such construction allows use of reflector trims of differing heights and further inhibits interference from larger size lamps. Thus closed housing cans, which are often utilized with low voltage lamps, have limited applicability with larger line voltage lamps. The open construction housing 60 further comprises opposed housing arms 62 which extend upwardly from a lower ring portion of the housing 60. The housing arms 62 may provide for some adjustability in a vertical direction of the reflector 70. For instance, the illustrative housing 60 utilizes a track system 61 in order to provide a connection between the housing 60 and reflector 70 as well as provide some adjustability. Further the open construction housing 60 allows better dissipation of heat created by the lamp within the reflector trim 70.

As shown in the exploded view shown in FIG. 4, a reflector 70 is shown below the housing 60 prior to installation where upon the housing 70 is moved upwardly through the housing 60. As previously indicated, the reflector 70 has a longer height dimension since the line-voltage lamps, utilized with the present invention, are longer in length than low-voltage lamps. The reflector 70 generally shown in FIG. 4 is a downlight reflector, however it is well within the scope of the present invention that a wall wash reflector, corner wash reflector, double wall-wash or other such reflector be utilized with the present invention.

Above the reflector is a reflector ring or casting 74 which connects to an upper portion of the reflector 70. The casting 74 is substantially annular in shape having a hollow center and an outer diameter which fits within the reflector 70. The casting 74 has at least one inner diameter which retains a lamp holder 76. The casting 74 is positioned within the upper reflector portion and a lamp holder 76 is centrally disposed within the casting 74. The annular shaped reflector ring serves two functions, first the ring 74 provides a means for connecting the reflector 70 and the lamp holder 76. Second, the casting 74 locates or centers the lamp within the reflector 70. The casting 74 further comprises opposed slots 75 which will be discussed further hereinafter.

Still referring to FIG. 4, the lamp holder 76 includes at least one wire 77 having opposed ends. At a first terminated end the at least one wire 77 is connected to terminals of the lamp holder 76. At the second terminated end is a wire harness quick connector 78. The quick connector 78 may be a male or female connector and is fastened to an opposed male or female quick connector 56 to splice together wires defining a circuit between the junction box 52 and the lamp holder 76.

Positioned above the lamp holder 76 is a spring 80 which is substantially U-shaped comprising two vertically disposed legs 82 and one horizontally extending leg 84 between the vertical legs 82. The horizontal leg 84 has two fastener apertures disposed therein to provide for positioning of fasteners 85 which engage a socket cup 40 described further hereinafter. The spring 80 further comprises a detent at a lower portion of each leg 82, each of which engage a diametrically opposed slot 75 in the casting 74 to retain the reflector 70, casting 74, lamp holder 76, and a socket cup 40 together as an assembly.

Figure 5:
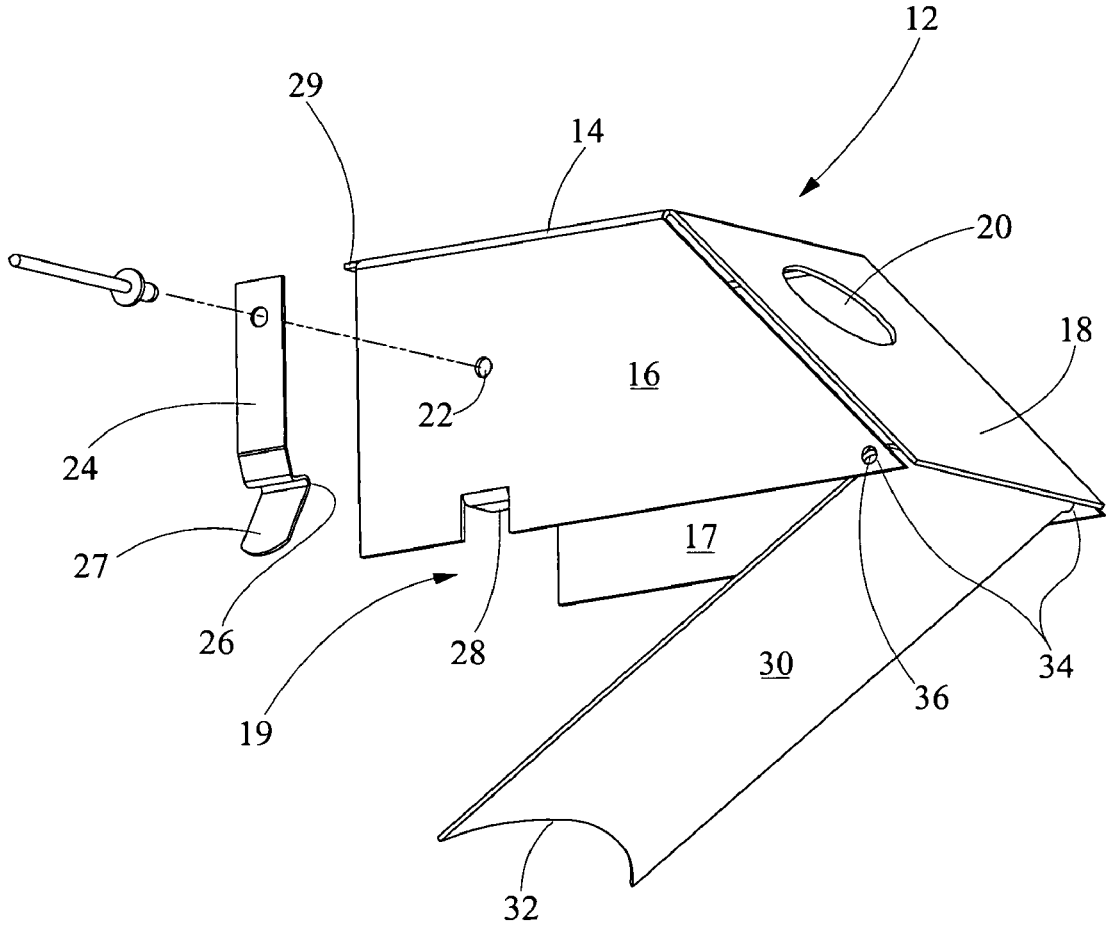
FIG. 5 is a perspective view of the enclosure and hinged plate.

Referring now to FIGS. 1, 2, 4 and 5, the present invention comprises an enclosure with socket cup 10 positioned above the housing 60 for receiving the casting 74, the spring 80, and the lamp holder 76 therein and providing a place for quick connection of wiring between the lamp holder 76 and the junction box 52. The enclosure 12 is defined by an enclosure top wall 14, two side surfaces 16, 17 depending from opposed edges of the top surface 14, an angled rear surface 18 and a releasably attached plate 30, which may be for instance hinged attached to the enclosure 12, defining a bottom surface of the enclosure. As shown in FIG. 5, the enclosure is substantially three-dimensional trapezoidal in shape however various shapes may be utilized. The enclosure 12 also comprises an angled surface 18 having a conduit aperture 20 therein. The conduit aperture 20 provides a pathway to and from the enclosure 12 for a conduit 53 extending between the junction box 52 and the enclosure 12. Extending through the conduit 53 is at least one wire 54 having a quick connector 56 terminating at an end of the wire 54. The interior of the enclosure 12 is accessed by releasing the spring 24 and pivoting the hinged plate downward to reveal the quick connector 56 and wire 54 therein.

The rear surface 18 of the enclosure 12 is angled so that, when installed, the enclosure 12 and conduit 53 extending from the angled rear surface will not exceed a height of about seven and one-quarter inches (7-¼") which is the typical height of a 2"×8" board, typically used for joist construction. In other words, when installed, the profile of the enclosure 12 and conduit 53 is at a height less than or equal to an adjacent joist so that the instant invention may be utilized in low-profile plenums.

Figure 2:
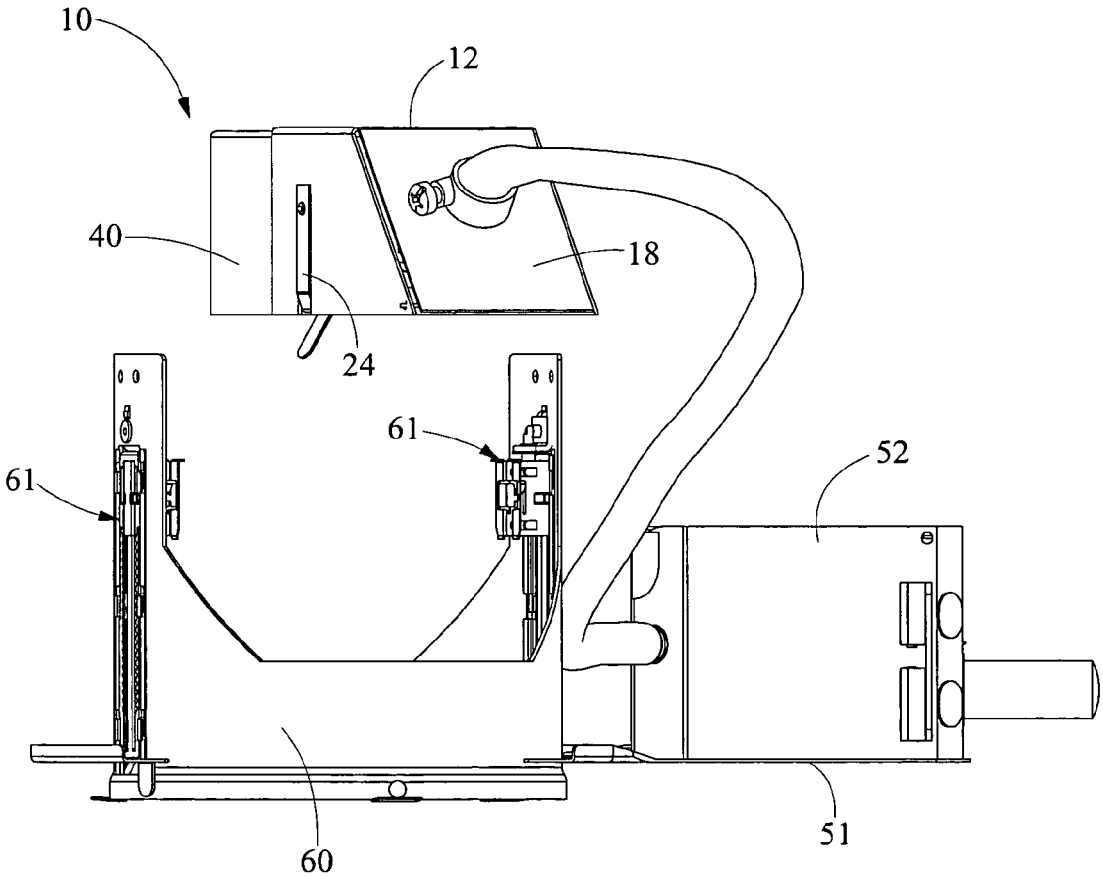
FIG. 2 is a side view of the remodeler recessed lighting kit and enclosure with socket cup of FIG. 1.

The enclosure sidewall 16 includes a fastening aperture 22 for fastening of a release spring 24 thereto. The release spring 24 is a resilient design and comprises a protrusion 26 extending inwardly from side wall 16 so that the hinged plate 30 is supported from below and thereby inhibited from opening. The release spring 24 includes a finger tab 27 which may be pulled away from enclosure 12 to remove the protrusion 26 from beneath the plate 30 allowing downward rotation of hinged plate 30 about hinge aperture 33 and hinge protrusion 36. Once pressure is removed from the finger tab 27, the release spring 24 resiliently returns to its position against the enclosure 12. Extending inwardly from the sidewall 16 is a stop or tab 28 which inhibits upward rotation of the hinged plate 30 beyond the stop or tab 28 extending inwardly into the enclosure 12. Thus, the stop 28 inhibits over rotation of the hinged plate 30 upwardly and the release spring supports the hinged plate 30 from beneath so that the plate 30 is fixed or captured in a closed position as shown in FIGS. 1 and 2.

The hinged plate 30 further comprises a curvilinear edge 32 partially defining an open front portion 19 of the enclosure 12. The open front portion 19 is defined by a lip 29 extending from the top wall 14, the first and second side wall 16, 17 depending from the top wall 14 adjacent the lip 29, and the curvilinear edge 32 of hinged plate 30. Since the enclosure 12 has this open front portion 19, a sixth wall is necessary for the enclosure 12 to fully enclose the splice area as required by electrical code.

Referring now to FIGS. 1, 3, 6 and 7, a socket cup 40 is positioned against the open front portion of the enclosure 12 in a mating fashion and forming a sixth wall of the enclosure 12 so that access to the enclosure 12 may only be obtained by pivoting of the hinged plate 30. The socket cup 40 has a top wall 42 and an annular side wall 45 depending from the peripheral edge of the top wall 42. The top wall 42 comprises opposed key ways 43 and opposed locking slots 44 connected to the key ways 43. The keyways 43 and locking slots 44 are combined to provide a twist-and-lock feature. The keyways 43 receive the heads of fasteners 85 from below and by rotating the socket cup 40 through a preselected angle so that the fasteners 85 move into the slots 44 and the fasteners can not be pulled through the socket cup 40. This configuration defines a twist-and-lock configuration. Once the casting 74, lamp holder 76 and reflector 70 are held in place by the spring 80, the socket cup 40 is positioned over the assembly and locked with a simple slight rotation.

Figure 7:
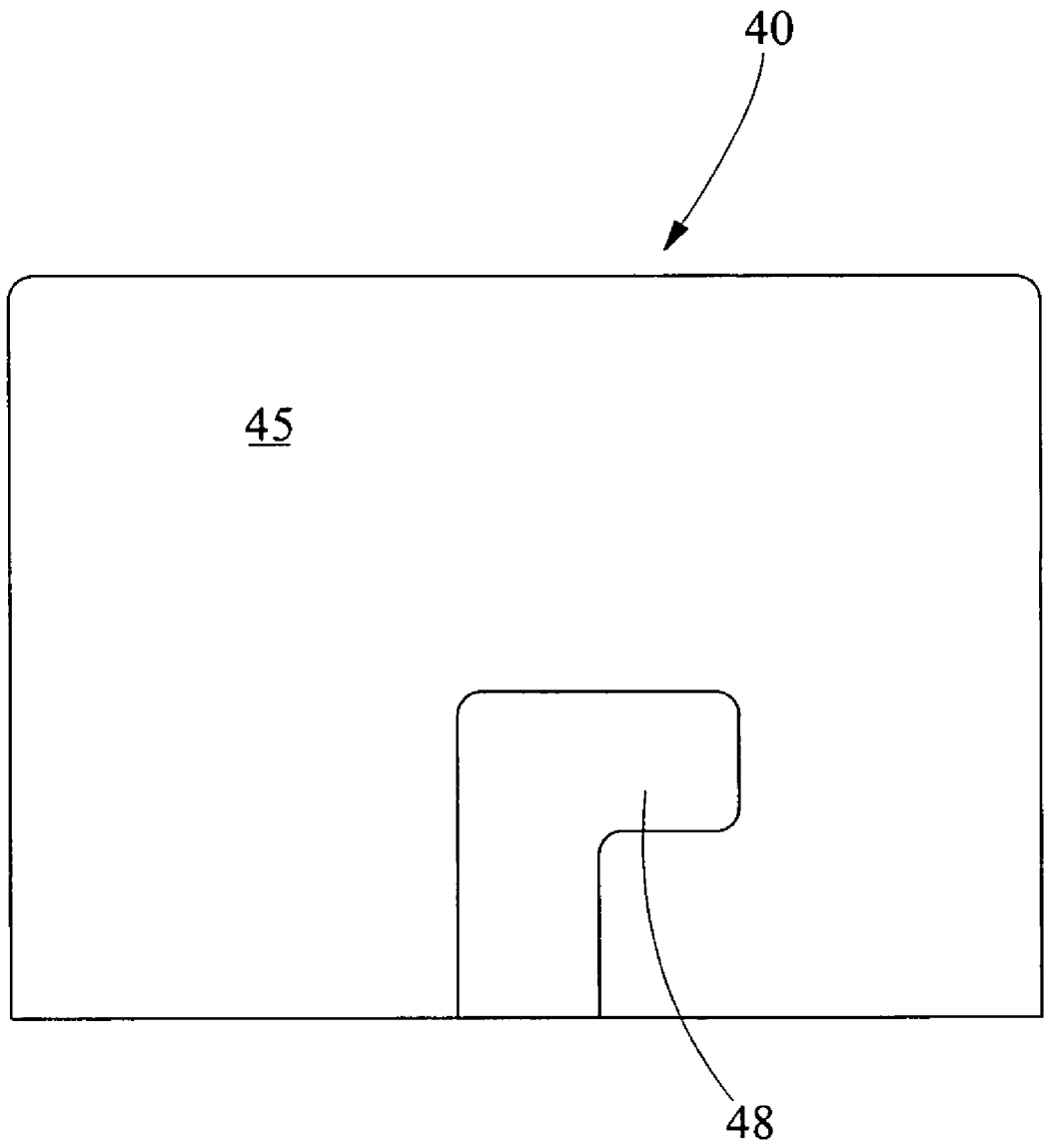
FIG. 7 is a side view of the socket cup of FIG. 6.

Referring now to FIG. 7, located within the annular side wall 45 of the socket cup 40 is a quick connection slot 48 being substantially L-shaped. The L-shaped slot 48 provides a pathway for a wire extending from a lamp holder through the socket cup 40 and into the enclosure 12. The wire extending from the lamp holder may have an opposed quick connector for engaging the quick connector 54 disposed within the enclosure 12 and connected to the wire 54 extending from the junction box 52.

Figure 3:
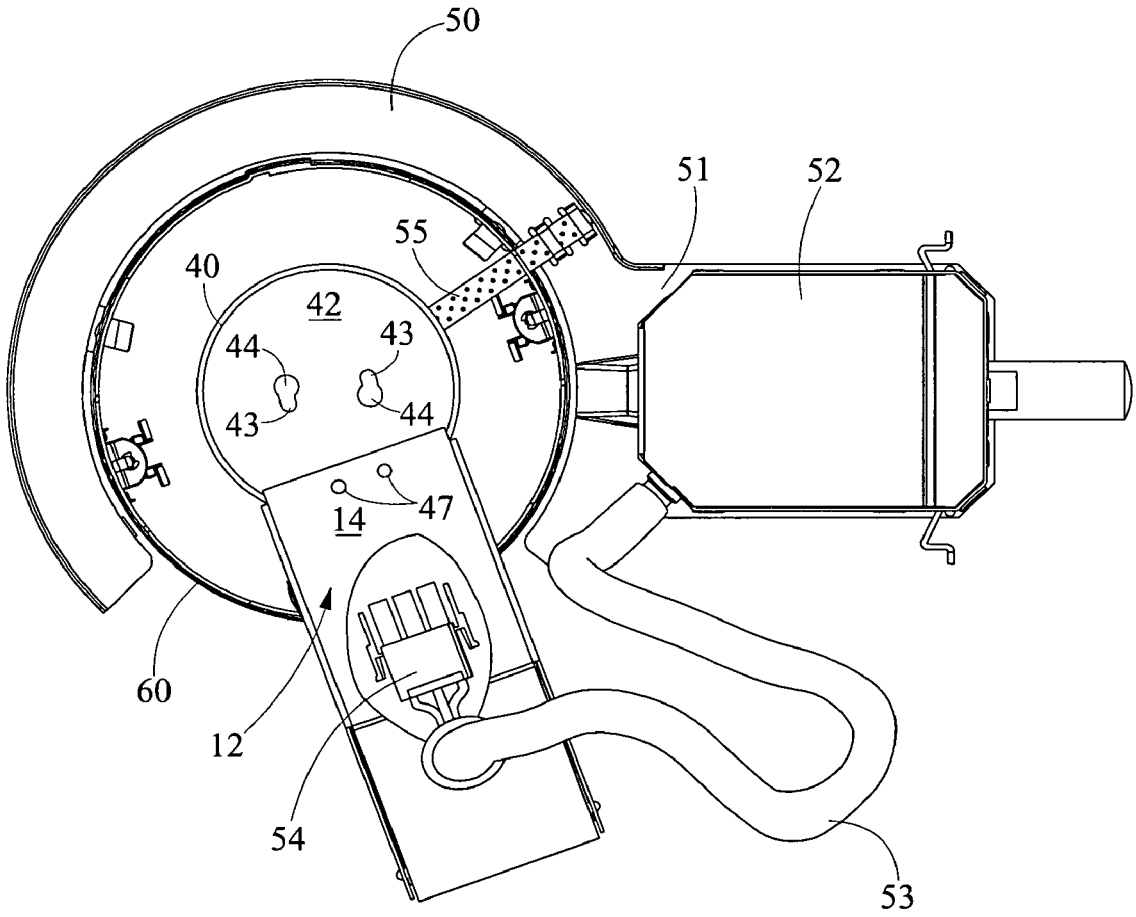
FIG. 3 is a top view of the remodeler recessed lighting kit of FIG. 1 including the enclosure with socket cup of FIG. 1.
Figure 6:
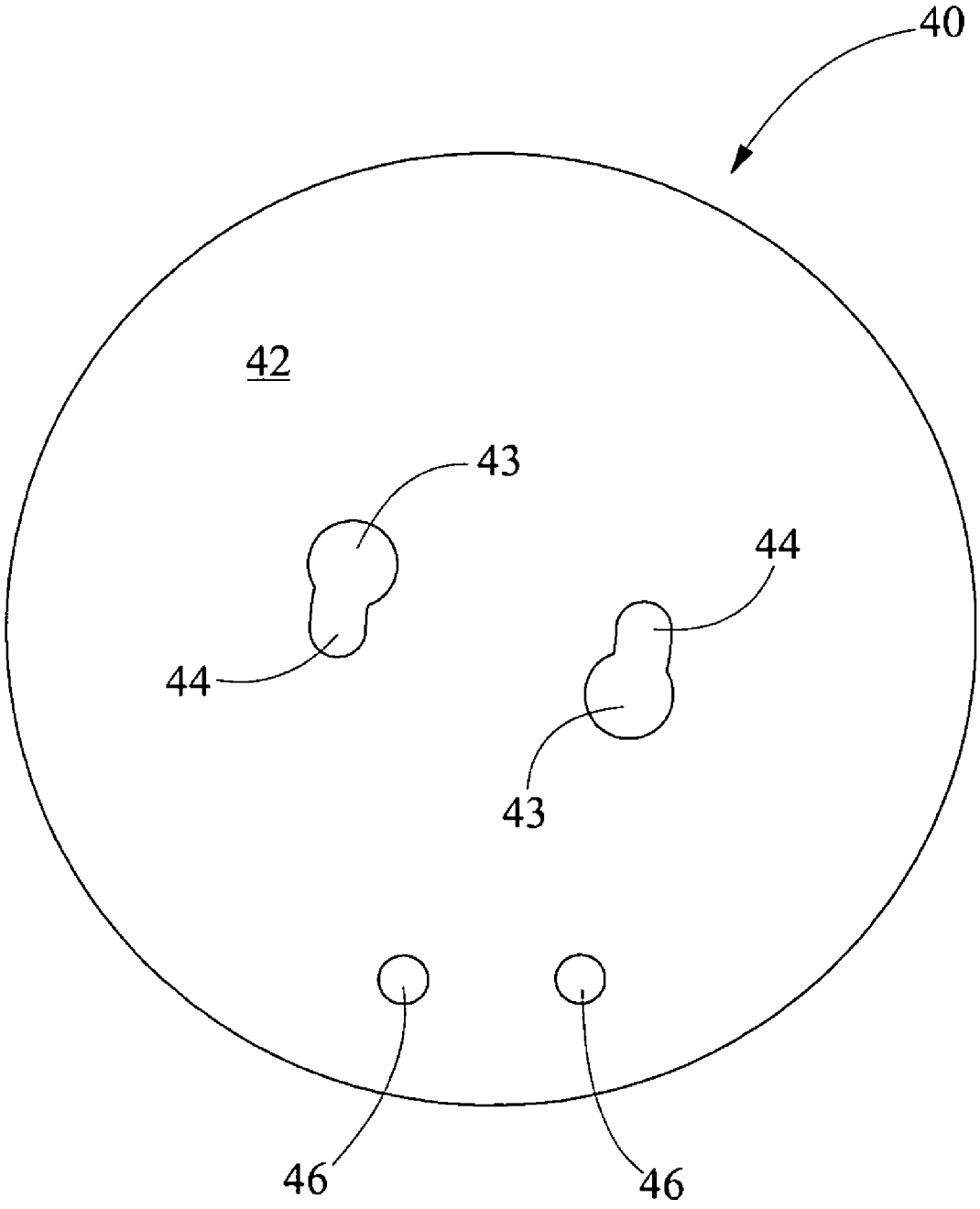
FIG. 6 is a top view of the socket cup including keyway apertures.

Referring now to FIGS. 3 and 6, the socket cup top wall 42 comprises first and second fastening apertures 46 therein which are aligned with apertures 47 on the top wall 14 of the enclosure 12. The fastening apertures 46, 47 are aligned and fastened for instance with rivets, screws or the like in order to retain the enclosure 12 against the socket cup 40. As one of ordinary skill in the art will understand, the curvilinear edge 32 of hinged plate 30 has a radius which is substantially equal to the radius of the annular side wall 45 so that the socket cup 40 and the enclosure 12 are engaging one another in close relationship and so that the interior of the enclosure 12 may only be accessed through the release and pivoting of the hinged plate 30.

As shown in the Figures, the enclosure with socket cup 10 is supported by a removable connection to a reflector trim 70 and is also connected to the junction box 52 by the conduit 53. Thus, an installer may utilize different reflector trims 70 of varying height in combination with the enclosure with socket cup 10. In other words, the enclosure 12 and socket cup 40 may be used with reflector trims of varying height. Another advantage of the present invention, is that the enclosure with socket cup 10 may be positioned through the housing 60 below a ceiling during installation and connected to a reflector trim before being reinserted upwardly through the housing 60 in place in the ceiling, thus providing one aspect of a remodeling capability.

In operation, the C-shaped frame 50, is inserted into a ceiling aperture and may hang therefrom with the junction box 52 accessible below the ceiling level for connecting the electrical wiring therein prior to installation in the ceiling. Once the electrical connections are made within the junction box 52 and wiring 54 is positioned through the conduit 53 with a quick connector 56 at a terminating end of the wire 54, the frame 50 including the platform 51 and junction box 52 are positioned above the ceiling level on an upper side of the ceiling. Next the housing 60 is positioned upwardly through the ceiling aperture and through the C-shaped frame 50 and may be retained in place by a bendable frame strap 55.

The housing 60 is then prepared for retention of the reflector trim which is positioned through the ceiling aperture and upwardly through the housing 60. This may occur by use of the track previously mentioned, clips, fastener, or the like. The socket cup 40 is fastened to the spring 80 by the twist-and-lock feature previously described. The hinged plate 30 is opened by placing an outwardly directed force on the spring release 24 away from the enclosure 12 so that the plate may be rotated downwardly. Within the enclosure 12, the quick connectors 56,77 are fastened together within the enclosure 12 to form a splice electrical connection between the junction box 52 and the lamp holder 76. After the connection is made, the connectors 56,77 and any excess wiring are positioned within the enclosure 12 and the hinged plate 30 is closed. The enclosure with socket cup 10 and reflector 70 assembly are positioned through the ceiling aperture and housing 60 until the reflector 70 is held in place.

We claim:

1. An enclosure with socket cup, comprising:

an open construction housing having an open upper area for receiving an enclosure and a socket cup;

said enclosure comprising:

an enclosure top wall;

at least one sidewall extending between said enclosure top wall and a releasably attached plate providing access to an interior of said enclosure;

said enclosure having an open portion;

said socket cup comprising:

a socket cup top wall and at least one side wall depending from said top wall and disposed against said open portion of said enclosure;

a lighting socket disposed within said socket cup for receiving a lamp;

said at least one socket cup sidewall having a pathway between said socket cup and said enclosure;

electrical wiring extending from said socket through said pathway to said enclosure.

2. The enclosure with socket cup of claim 1, said enclosure providing a space for mating quick connectors electrically connected to and extending from a junction box and a lamp holder respectively.

3. The enclosure with socket cup of claim 2, said enclosure having a conduit aperture providing a pathway for a conduit extending from said junction box.

4. The enclosure with socket cup of claim 1, said open portion of said enclosure engaging said socket cup which further defines an enclosure wall.

5. The enclosure with socket cup of claim 1 wherein said enclosure with said socket cup are positionable at various heights relative to said open construction housing.

6. The enclosure with socket cup of claim 5 wherein said enclosure with socket cup is positioned above said open construction housing on a reflector trim.

7. The enclosure with socket cup of claim 1 further comprising a tab extending inwardly from said at least one enclosure sidewall.

8. The enclosure with socket cup of claim 1 further comprising a release spring having a retaining projection fastened to an outer surface of said at least one enclosure sidewall.

9. The enclosure with socket cup of claim 1, said releasably attached plate captured between a tab extending inwardly from said enclosure sidewall and a release spring having a projection positioned beneath said releasably attached plate.

10. The enclosure with socket cup of claim 9, said releasably attached plate being a hinged plate.

11. An enclosure with socket cup for use with a remodeler recessed lighting kit, comprising:

a housing having an upper open construction for positioning of a socket cup and an enclosure:

said socket cup comprising:

a socket cup sidewall depending from a socket cup top wall;

said socket cup being substantially cylindrical in shape and having a hollow interior and having a lamp socket connected to said socket cup;

said enclosure comprising:

a top wall defining a lip for connection to said socket cup;

two opposed sidewalls depending from said enclosure top wall;

an angled enclosure wall extending between said two opposed sidewalls;

a releasably attached plate defining an enclosure bottom hingedly connected to said enclosure;

said enclosure having an open portion receiving said socket cup, said socket cup sidewall defining a closing wall of said enclosure.

12. The enclosure with socket cup of claim 11, said socket cup having a pathway for wiring from said socket cup to said enclosure.

13. The enclosure with socket cup of claim 12, said pathway defined by a notch in said sidewall of said socket cup.

14. The enclosure with socket cup of claim 13, said notch being substantially L-shaped.

15. The enclosure with socket cup of claim 11, further comprising a release spring fastened to said enclosure and retaining said releasably attached plate in a closed position.

16. The enclosure with socket cup of claim 15, said release spring having a protrusion engaging said releasably attached plate from below.

17. The enclosure with socket cup of claim 11, further comprising at least one conduit extending through said angled wall.

18. The enclosure with socket cup of claim 17, further comprising a wire extending through said conduit, said wire having a first quick connector as a terminating end thereof.

19. The enclosure with socket cup of claim 18, further comprising a second quick connector extending from a lamp holder and engaging said first quick connector.

20. The enclosure with socket cup of claim 19, said second quick connector passing from said socket cup to said enclosure through a notch in said socket cup sidewall.

21. The enclosure with socket cup of claim 19, said first quick connector and second quick connector disposed within said enclosure.

22. The enclosure with socket cup of claim 11, said enclosure with socket cup being capable of receiving a plurality reflector trim sizes.

23. An enclosure with socket cup for use with a line voltage recessed lighting kit, comprising: an open construction housing which adjustably retains a reflector, said housing having an upper open area for positioning of a socket cup; an enclosure for a splice connection between a lampholder and a junction box; said enclosure having a top wall, an open portion, at least one enclosure sidewall extending between said top wall and a releasably attached plate providing access to said enclosure; a socket cup having at least one socket cup sidewall engaging said open portion of said enclosure; a lamp socket disposed within said socket cup, said socket cup having a socket cup top wall and at least one socket cup sidewall depending from said top wall and said socket cup disposed against said open portion of said enclosure; said at least one socket cup sidewall providing a pathway between said socket cup and said enclosure for wiring from said socket to an interior of said enclosure.

24. The enclosure with socket cup of claim 23 wherein said enclosure receives reflector trims of different height.

25. An enclosure with socket cup assembly for use with a lighting assembly, comprising:

an open construction housing which adjustably retains a reflector therein, said open construction housing having an upper open end;

a said socket cup comprising:

a socket cup sidewall depending from a socket cup top wall;

an enclosure comprising:

a top wall defining a lip for connection to said socket cup;

two opposed sidewalls depending from said enclosure top wall;

an angled enclosure wall extending between said two opposed sidewalls;

a releasably attached plate defining an enclosure bottom hingedly connected to said enclosure;

said enclosure having an open portion receiving said socket cup, said socket cup sidewall defining a closing wall of said enclosure;

said socket cup and enclosure disposed at said open end of said housing for receiving said reflector.

* * * * *